United States Patent [19]

Barthelemy et al.

[11] Patent Number: 4,909,673

[45] Date of Patent: Mar. 20, 1990

[54] PROCESS AND DEVICE FOR THE INJECTION OF A SLURRY IN THE VICINITY OF THE WALLS OF A TUBULAR PILE DRIVEN INTO THE GROUND

[75] Inventors: Hervé Barthelemy, Croissy-sur-Seine; Michel Brochier, Palaiseau; Jean-Paul Geffriaud, Paris; Yves Legendre, Balloy, all of France

[73] Assignee: Societe Anonyme dite: Soletanche, Nanterre, France

[21] Appl. No.: 204,561

[22] Filed: Jun. 9, 1988

[30] Foreign Application Priority Data

Jun. 10, 1987 [FR] France ..... 87 08056

[51] Int. Cl.[4] ..... E02D 5/22; B23P 17/00

[52] U.S. Cl. ..... 405/231; 29/155 R; 29/157.1 R; 29/455.1; 29/460; 405/248; 405/269

[58] Field of Search ..... 29/455.1, 157.1 R, 460, 29/155 R; 405/227, 233, 225, 228, 269, 248, 236, 250, 276, 231, 232, 272; 285/286

[56] References Cited

U.S. PATENT DOCUMENTS

| | | | |
|---|---|---|---|
| 1,529,113 | 3/1925 | Burns | 405/248 |
| 2,101,405 | 12/1937 | McKeever | 285/286 X |
| 2,196,211 | 4/1940 | Hartman | 405/269 |
| 2,832,570 | 4/1958 | Schoessow | 285/286 X |
| 3,151,890 | 10/1964 | Schrock et al. | 285/286 X |
| 3,194,591 | 7/1965 | Weisend | 285/286 X |
| 4,240,767 | 12/1980 | Gracia | 405/227 |
| 4,253,781 | 3/1981 | Fischer et al. | 405/269 X |
| 4,545,605 | 10/1985 | Gerber et al. | 285/286 X |

FOREIGN PATENT DOCUMENTS

| | | |
|---|---|---|
| 0151389 | 8/1985 | European Pat. Off. . |
| 2569816 | 3/1986 | France . |
| 2158493A | 11/1985 | United Kingdom . |

*Primary Examiner*—Charlie T. Moon

*Attorney, Agent, or Firm*—Schweitzer & Cornman

[57] ABSTRACT

A process for attaching an injection pipe with injection valve means to the inside wall of a tubular pile section comprising: drilling holes at a plurality of points along a generatrix of the pile section said holes passing through the wall of the pile; preparing an injection pipe having substantially the same length as the section of the pile to which it is to be attached; connecting said injection pipe with injection valve to said pipe, the spacings between said valve means corresponding to those of the said holes drilled in the wall of the pipe; engaging said injection pipe in the interior of the pile while positioning the injection valve means into said holes drilled in the pile; and welding said valve means to the wall of the pile from the exterior of the pile.

10 Claims, 5 Drawing Sheets

PROCESS AND DEVICE FOR THE INJECTION OF A SLURRY IN THE VICINITY OF THE WALLS OF A TUBULAR PILE DRIVEN INTO THE GROUND

BACKGROUND OF THE INVENTION

The present invention relates to a new device for the injection of a slurry in the vicinity of the wall of a pile installed in the ground by driving, vibration, jetting, lowering into a drilled hole, or by any other appropriate means.

It is known that in some cases tubular piles installed in the ground to support, for example, petroleum-drilling rigs at sea, do not provide sufficient lateral friction, especially in carbonate soils. It is also known that it is then possible to increase this resistance by injecting under pressure a hardenable slurry, for example based on cement, in the vicinity of the walls of the tubular pile. This injection may be effected either outside the pile to increase the friction of the wall of the pile in relation to the soil, or in the interior of the pile in order to impart a rigidity to the soil there for the purpose of increasing the resistance of the pile to indentations.

The application of a method of this kind necessitates the installation along at least one of the generatrices of the pile of an injection tube composed of a steel tube of relatively small diameter which is connected at various points to injection valves which are located in or close to the wall of the pile and which permit the flow of the slurry when the pressure in the injection pipe is greater than that prevailing in the vicinity of the wall of the pile, without, however, allowing the slurry injected in this way to move in the opposite direction and return to the injection pipe.

In view of the fact that piles of this type may be several meters in diameter and that tens of meters of piles must be driven into the ground, it is desirable that the valves and the injection pipe should occupy the least possible space so as not to offer any noteworthy resistance to the driving.

It is also necessary for the attachment of the injection pipe to the wall of the tubular pile and the connections of it to the various valves to be perfectly resistant to the forces and vibrations which may be produced when the pile is installed.

SUMMARY OF THE PRESENT INVENTION

The present invention relates to a method and a device for the simple and reliable mounting of the injection pipe on the tubular pile and for the connection of the injection pipe with the valves.

A further object of the present invention is a simple, efficient and compact valve which can be used in particular with the device to which reference has just been made.

The effect of the present invention is a method of fixing an injection pipe and injection valves on the wall of a tubular pile section, characterized in that: openings are drilled at various points along a generatrix of the pile, these openings passing through the wall of the latter; that an injection pipe is prepared which has substantially the same length as that of the pile section, this pipe comprising injection valves or means for receiving such valves as well as fixing elements, the spacing and dimensions of which correspond to those of the openings made in the wall of the pile; that the injection tube thus constituted is engaged in the interior of the pile by introducing the fixing means into the openings of the pile; and that from the exterior of the pile each fixing element is welded to the wall of the pile.

In a first embodiment intended for the installation of an injection pipe for injecting a slurry on the exterior of the pile the method according to the invention is characterized in that a series of openings, the diameters of which correspond to the diameter of the valve supports which it is desired to place there, is drilled radially along a generatrix of the pile and at the locations of the valves; that openings, the axes of which are the same distance apart as are the openings made in the wall of the tubular pile, are made along a generatrix of the injection pipe; that in the axis of each of these openings a valve support is welded on to the injection pipe; that the injection pipe fitted in this way with the valve supports is engaged in the interior of the pile by causing each of the valve supports to emerge in one of the openings made in the wall of the pile; that from the exterior of the pile each of the valve supports is welded on to the wall of the pile, said supports serving as fixing means; and that the elements which constitute the valve proper are fixed into each valve support.

It can be seen that in accordance with the method according to the invention, since the valve supports are welded on to the injection pipe before this is placed inside the tubular pile, and since each valve support is welded to the wall of the pile from the exterior of the latter, it is not necessary to carry out any welding inside the pile.

The method according to the invention also has the advantage of being able to install the constituent elements of the valve only just before the installation of the pile, which reduces the danger of damage to them.

In a second embodiment intended to install an injection pipe for injecting a slurry inside the pile the method according to the invention is characterized in that a series of openings is drilled radially along a generatrix of the pile; that a series of fixing means, the dimensions and spacing of which correspond to those of the openings made in the wall of the pile, is attached along a generatrix of the injection pipe; that injection valves opening towards the interior of the pile, or supports for such valves, are fixed on the injection pipe; that the injection pipe is engaged in the interior of the pile by introducing the fixing means into the openings made in the wall of the pile; and that the fixing means are welded to the wall of the pile from the exterior.

It can be seen that in this case the injection tube is also fixed by means of welds made outside the tubular pile.

According to the invention, at least one injection tube is disposed on each section of tubular pile.

The various sections are connected either by means of flanged sleeves which make it possible to join the ends of the injection pipes of the different sections, or else by the fact that funnel shapes are imparted to the ends of the injection pipes which permit an easy passage of the injection device at the point of connection of two sections of tubular piles.

According to a first embodiment, of the invention the injection pipe is a continuous pipe, the length of which corresponds to that of the pile section in which the pipe is to be placed.

According to a second embodiment of the invention the injection pipe is composed of sub-sections which are connected at each side and in the vicinity of the valve supports, nesting one within the other with the interpolation of a joint, for example a toric joint, so that the vibrations produced on the installation of the pile have no repercussions in the various injection pipe sub-sections and there is no danger of damage to the attachment of the valve supports in the wall of the piles.

A further object of the present invention is a pile provided with a device for the injection of slurry obtained by the process which has just been described.

The present invention also relates to an injection valve particularly well adapted to be used in cooperation with the process and the device which have just been described.

Another object of the present invention is a valve which can be used with the process described above and which is characterized in that it comprises a core capable of being engaged by screwing into a threaded opening made in the injection pipe from the exterior of the pile, said core comprising in addition a central cavity which opens towards the interior of the injection pipe and which is connected to the periphery of the core by slightly divergent channels to guide the injection slurry, said core also being provided with retaining means so as to hold a tubular rubber sleeve disposed on its periphery in order to close the aforementioned divergent channels, as well as a compressible ring made of foamed elastomer located between said sleeve and the body of the valve to push the sleeve constantly against the valve core when the pressure prevailing in the interior of the injection pipe is lower than the pressure prevailing on the exterior of the tubular pile.

With the object of better explaining the invention a description will now be given, by way of illustration and in now way of a limiting nature, of one embodiment taken as an example and shown .in the attached drawing.

DESCRIPTION OF THE DRAWINGS

In this drawing

DETAILED DESCRIPTION OF INVENTION

Figure 1:
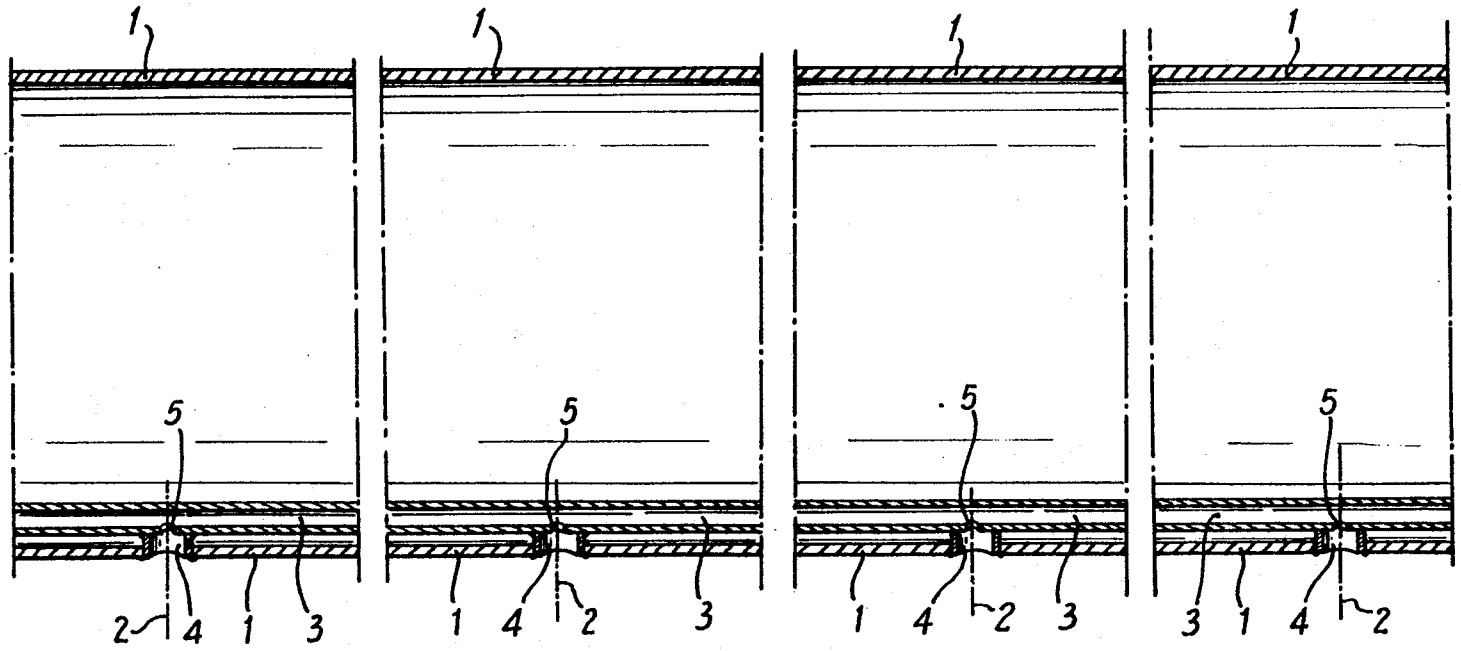
FIG. 1 is a diagrammatical sectional view of a tubular pile element on a generatrix of which have been located an injection pipe and injection valve bodies in accordance with a first embodiment of the invention.
Figure 2:
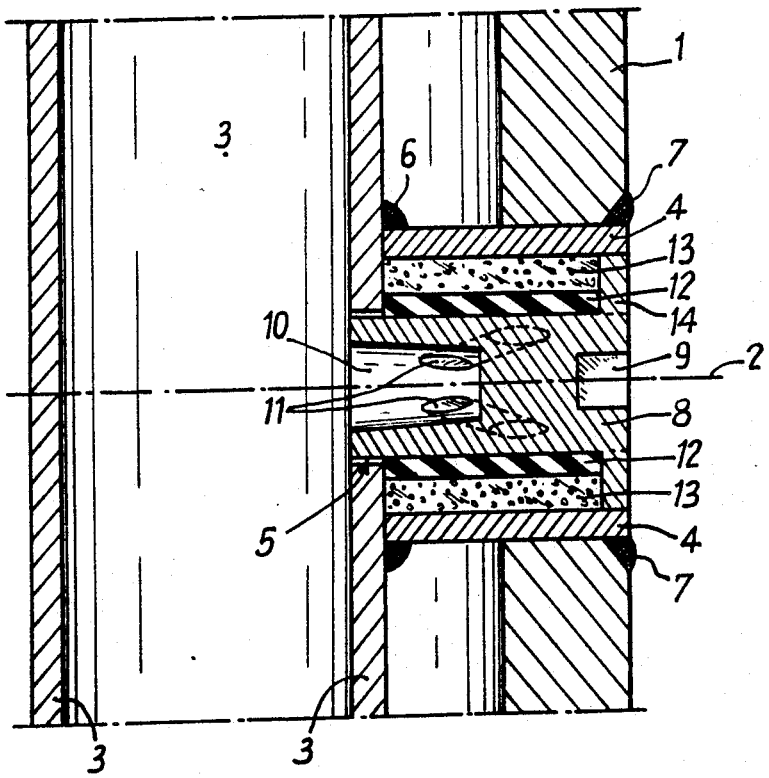
FIG. 2 is a sectional view along the line II—II in FIG. 3 of a valve according to the invention mounted on the wall of a tubular pile.
Figure 3:
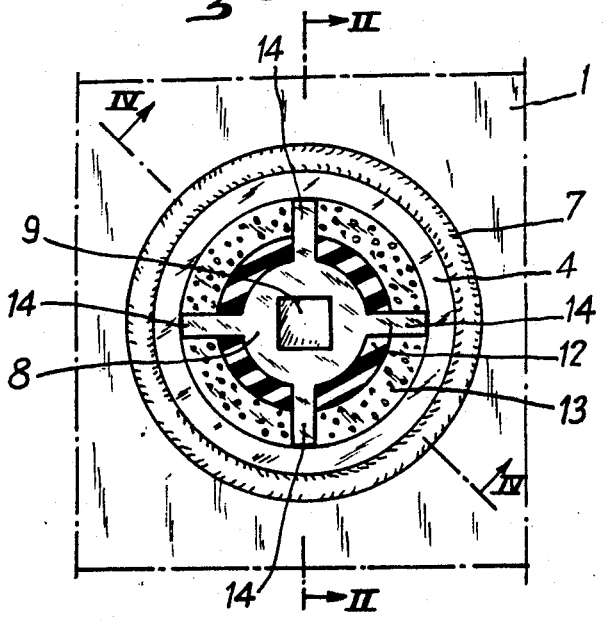
FIG. 3 is a face view of FIG. 2.

In FIG. 1 a longitudinal sectional been shown of a pile element disposed horizontallY before its installation, only the parts of it which have injection valves being shown. It is clear that these valves are spaced more widely apart than is shown in the, drawing. This is the reason why the tubular element has been broken down into four sections separated by dot-dash lines.

The axes of the injection valves which must be disposed along the interior generatrix of the pile 1 have been shown at 2.

The injection pipe 3, which is disposed along the interior generatrix of the pile 1 and which bears tubular sleeves 4 welded on to it about openings 5 can be clearly seen in FIG. 1. These sleeves (4) constitute the bodies of each of the valves.

According to the invention, the openings 5 are first made along a generatrix of the pipe 3 while this is still in the workshop, and the tubular sleeves 4, which are intended to constitute the bodies of the injection valves are then welded in the axes of the openings 5.

It is clear that the openings 5 are made at distances which correspond to the positions which the valves must occupy on the generatrix of the pile 1.

After preparing the injection pipe in this way, openings the diameters of which are equal to or very slightly greater than the external diameters of the tubular sleeves 4 which were welded on to the injection pipe 3 at the points which correspond to those of the injection valves which it is desired to locate on the pile are made on the generatrix of the pile element 1.

From the external surface of the pile a chamfer is made on the periphery of the openings produced in this way so as to permit the welding of the tubular sleeves, as will be seen more clearly from the following figures. In one variant the chamfer may be made at the end of the sleeve 4.

The injection pipe 3 fitted with the sleeves 4 is introduced into the interior of the pile element 1 and the tubular sleeves 4 are introduced into the openings provided for this purpose in the wall of the pile 1 until the ends of said sleeves 4 are flush with the external surface of the pile. Because of the chamfer it is possible to weld the ends of the tubular sleeves 4 on to the external surface of the wall of the pile 1, thus satisfactorily securing the injection pipe 3 to the pile.

In FIGS. 2 to 5, which represent one particular embodiment of a valve which can be used with the process and the device which have just been described, the wall of the pile 1 is shown, together with the injection pipe 3, on to which a tubular sleeve 4 is welded at 6 in the axis 2 of the valve.

It can be seen from these figures how the end of the tubular sleeve 4 is engaged in the corresponding opening in the wall of the pile 1, being held by an annular welded seam 7.

It can also be seen from these figures how the core 8 of the valve is fixed by screwing its inner end into the threaded opening 5 made in the wall of the injection pipe 3.

To facilitate this screwing, a recess 9 of square section is made in the core 8 on the outer side of the wall of the tubular pile.

On the inner side the core 8 has a tapered cavity 10 which opens in the interior of the injection pipe 3 and which opens by way of oblique channels 11 (only two of which can be seen in the drawing) on the outer periphery of the core 8.

The external periphery of the core 8, which is cylindrical in shape, is surrounded by a rubber sleeve 12 which has a Shore hardness of 60, for example, and which is itself separated from the body 4 of the valve by an annular body 13 made of a porous elastomer and having a Shore hardness of about 40, for example.

In the embodiment shown, the end of the core 8 has, on the side of the external surface of the pile, four retaining means 14 which hold in place the sleeve 12 and the porous tubular elastomer body 13.

To install the valve it is sufficient, after placing on the core 8 the sleeve 12 then the annular body 13 made of porous elastomer, to insert the core 8 into the sleeve 4 and to screw the inner end of the core 8 into the bore 5 of the wall of the injection pipe 3, which can be easily effected by means of a square which engages in the recess 9.

Figure 4:
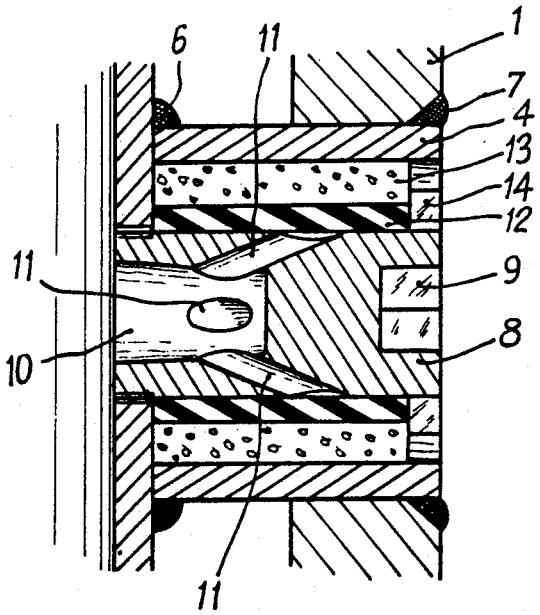
FIG. 4 is a section along the line IV—IV in FIG. 3, the valve being in the rest position.

The various elements which have been described can be found in FIG. 4, which is a sectional view along the axis of the channels 11.

Figure 5:
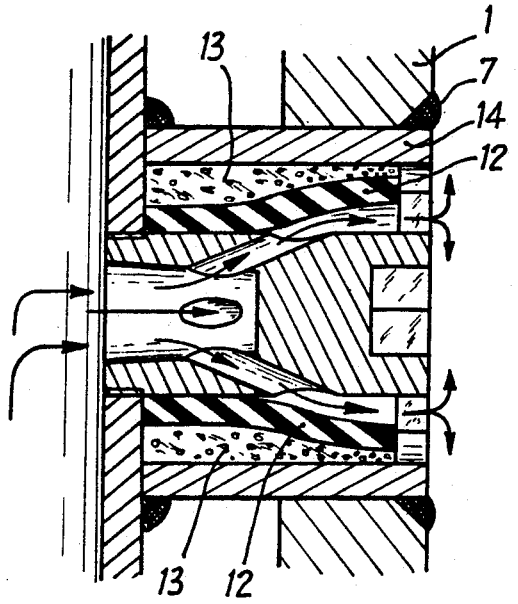
FIG. 5 is a view corresponding to FIG. 4 on the injection of slurry.

When slurry under pressure is forced into the interior of the injection pipe 3, this develops its pressure inside the cavity 10 and the channels 11 by pushing, as is seen in FIG. 5, the sleeve 12 towards the exterior on account of the compression of the porous elastomer 13.

The slurry under pressure thus has the possibility of flowing to the exterior of the pile, passing beside the retaining means 14,, as is indicated by the arrows in FIG. 5.

As soon as the pressure inside the injection pipe becomes lower than that which prevails outside the pile, the sleeve 12 is retracted, closing the openings 11 and the porous elastomer 13 comes to rest once more against the cylindrical periphery of the core 8, thus preventing the slurry or any other liquid present outside the pile from following the reverse course and penetrating into the interior of the injection pipe.

The slurry can be brought under pressure at the level of the valve by a known means, composed, for example, of an injection line fitted with two expandable sealers which is lowered into the injection pipe.

Figure 6:
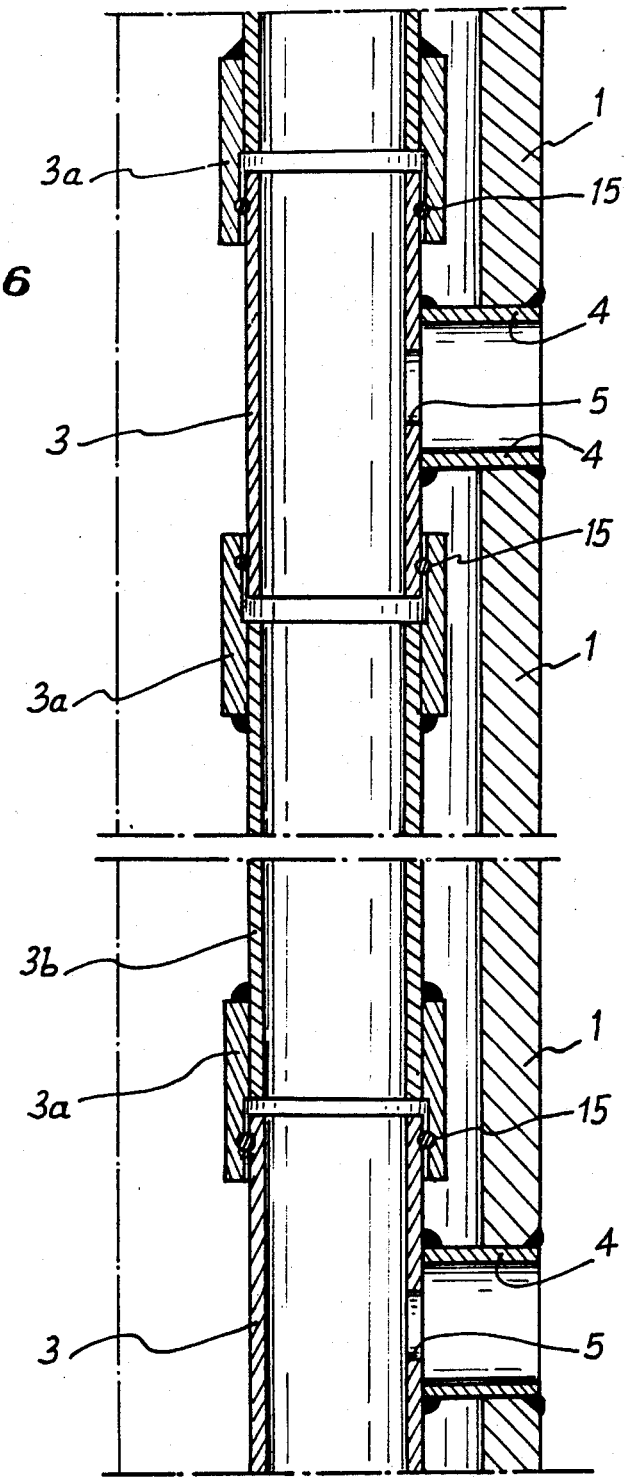
FIG. 6 is a sectional view on a larger scale of a variant of the injection pipe in the vicinity of a valve.

In FIG. 6 has been shown a variant in which the injection pipe is composed of two sub-sections 3 integrally formed with the valve supports 4 on which engage sleeves **3*a* of larger diameter which are welded at the ends of subsections 3*b*, the lengths of which correspond substantially to the distance separating two sub-sections 3** from each other.

Joints 15 provide sealing and a solid connection between the various sub-sections which constitute the injection pipe.

The joints 15 may, for example, be toric autoclave joints made of an elastomer of a known type.

This variant of the invention has the advantage of isolating the various sub-sections from each other and avoiding any repercussion of vibrations on the valve supports, the welds of which might in some cases be damaged, during the installation of the pile.

In accordance with the invention, the joints 15 provide sufficient retention of the sub-sections 3 in the sleeves **3*a*** for the assembly composed of the various sub-sections to behave like a single tube when the injection pipe is installed.

In the embodiment shown a joint connection 15 is disposed on each side of each of the valve supports 4, but it is clear that in a variant of this second embodiment it would also be possible to dispose only one joint connection 15 between each two consecutive valve supports 4.

Figure 7:
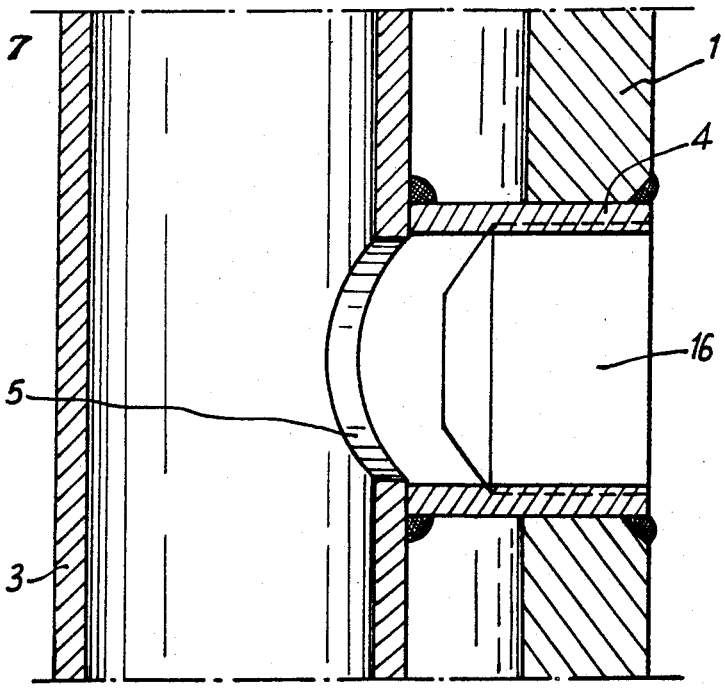
FIG. 7 is a variant of the valve of FIG. 2.

FIG. 7 shows a variant of the FIGS. 2 to 5 in which, instead of the sleeve 4 constituting the outer body of the valve, this sleeve receives by screwing a valve 16 which is a complete unit which was assembled prior to its installation in the sleeve 4.

Figure 8:
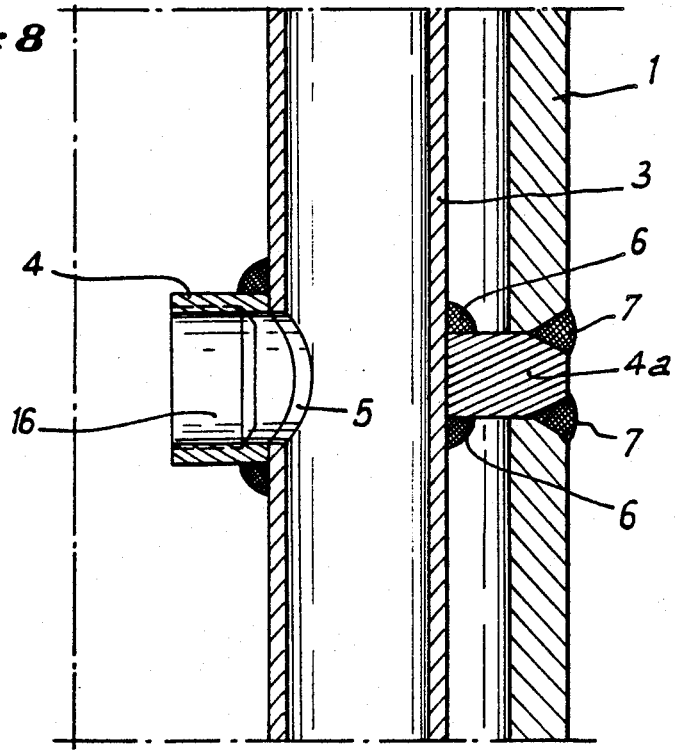
FIG. 8 is a diagrammatic sectional view of a second embodiment of the invention.

FIG. 8 shows diagrammatically the second embodiment of the invention.

The wall 1 of the pile and the injection pipe 3 can be seen in this figure.

In this embodiment the pipe 3 is fitted with a fixing means **4*a*, composed in the present case of an unreduced shaft which is attached from the exterior of the pile by a welded seam 6**.

On the other side a valve support sleeve 4 is attached by welding to the pipe about an opening 5.

A valve 16 is screwed into the valve support 4 as explained in the case of FIG. 7.

The injection pipe having been assembled in this way, it is sufficient to introduce it into the interior of the pile 1 and to engage the fixing means **4*a* in the corresponding openings of the wall of the pile to be able to fix the injection pipe 3 solidly to the pile by means of welded seams 7**.

In this embodiment, of course: it is also possible to prepare the injection pipe in several sub-sections, as is shown in FIG. 6.

It can be seen that through the invention it is possible to install in a simple, rapid and economical manner the injection pipe and also the various valves which are to be located in the wall of the pile.

It can also be seen that through the invention it is possible to obtain by economical means a particularly simple injection valve, the thickness of which is of the same order of magnitude as the thickness of the wall of the pile.

It is clearly understood that the embodiments which have been described above are in no way of a limiting nature and that they may be subjected to any desirable modifications without going beyond the scope of the invention.

It is clear, in particular, that the valves which have been described may be used to effect the injection of slurry both at the external surface of the wall of the pile and at the internal surface of it, in which case the valves must obviously be directed towards the interior of the pile.

Similarly, it goes without saying that the various parts of the injection pipe may be prepared differently from the manner which has been described, in particular by using pieces of shapes such as a letter T.

We claim:

1. A process for attaching an injection pipe with injection valve means to the inside wall of a tubular pile section comprising:

(a) drilling holes at a plurality of longitudinally spaced points along a generatrix of the pile section said holes passing through the tubular wall of the pile;

(b) preparing an injection pipe having substantially the same length as the section of the pile to which it is to be attached;

(c) connecting said injection valve means to said pipe, the spacings between said valve means corresponding to those of the said holes drilled in the wall of the pipe;

(d) engaging said injection pipe in the interior of the pile while positioning the injection valve means into said holes drilled in the pile; and (e) welding said valve means to the outside of the wall of the pile from the exterior of the pile.

2. A process according to claim 1 further including the step of:

(a) cutting chamfers on the outer surface of the pile wall around the holes drilled in said wall for facilitating the welding of said valve means from the outside of the pile.

3. A process according to claim 2 further including the step of:

(a) cutting a chamfer on the end of the outer surface of the valve means for supporting such valve means for facilitating the welding of the same on the outside surface of the pile wall.

4. A process as claimed in claim 3 further including the step of:

(a) assembling a plurality of subsections of injection pipes.

5. A tubular pile including:

(a) a tubular wall with holes drilled at a plurality of longitudinally spaced points of one generatrix of said wall, said holes extending through the wall of the pile, and (b) an injection pipe connected to a plurality of injection valve means, said valve means being engaged from the inside of the pipe into the holes drilled in the pile wall and being welded to the outside of the pile wall from the outside of the pile.

6. A process for attaching an injection pipe with injection valves to the inside wall of a tubular pile section comprising:

(a) drilling holes at a plurality of longitudinally spaced points along a generatrix of the pile section, said holes passing through the tubular wall of the pile;

(b) preparing an injection pipe having substantially the same length as the section of the pile;

(c) connecting injection valves to said injection pipe;

(d) providing said injection pipe with connecting elements, the spacings between said connecting elements corresponding to those of the injection valves and said holes drilled in the wall of the pile;

(e) engaging said injection pipe in the interior of the pile while positioning the connecting elements into the holes drilled in the pile and welding said connecting elements to the outside of the wall of the pile from the exterior of the pile.

7. A process according to claim 6 further including the step of:

(a) cutting chamfers on the outer surface of the pile wall around the holes drilled in said wall for facilitating the welding of said connecting elements from the outside of the pile.

8. A process according to claim 7 further including the step of:

(a) cutting a chamfer on the end of the connecting elements for facilitating the welding of the same on the outside surface of the pile wall.

9. A process as claimed in claim 8 further including the step of:

(a) assembling a plurality of subsections of injection pipes.

10. A tubular pile including:

(a) a tubular wall with holes drilled at a plurality of longitudinally spaced points of one generatrix of said wall, said holes passing through the wall of the pile;

(b) an injection pipe comprising injection valves and connecting elements; and (c) said connecting elements being engaged from the inside of the pile into the holes drilled in the pile wall and being welded to the outside of the pile wall from the outside of the pile.

* * * * *